US007878263B2

(12) United States Patent
Keskiniva et al.

(10) Patent No.: US 7,878,263 B2
(45) Date of Patent: Feb. 1, 2011

(54) PRESSURE-FLUID-OPERATED PERCUSSION DEVICE

(75) Inventors: Markku Keskiniva, Tampere (FI); Jorma Maki, Mutala (FI); Mauri Esko, Ikaalinen (FI); Erkki Ahola, Kangasala (FI); Aimo Helin, Tampere (FI)

(73) Assignee: Sandvik Mining and Construction OY, Tampere (FI)

( * ) Notice: Subject to any disclaimer, the term of this patent is extended or adjusted under 35 U.S.C. 154(b) by 0 days.

(21) Appl. No.: 10/590,205

(22) PCT Filed: Feb. 22, 2005

(86) PCT No.: PCT/FI2005/050045

§ 371 (c)(1),
(2), (4) Date: Aug. 22, 2006

(87) PCT Pub. No.: WO2005/080051

PCT Pub. Date: Sep. 1, 2005

(65) Prior Publication Data

US 2007/0199725 A1 Aug. 30, 2007

(30) Foreign Application Priority Data

Feb. 23, 2004 (FI) ..... 20040278

(51) Int. Cl.
*B25D 9/06* (2006.01)

(52) U.S. Cl. ..... 173/90; 173/200; 173/204; 173/212; 173/138; 173/14; 91/417 R

(58) Field of Classification Search ..... 173/90, 173/206–208, 138, 204, 14, 200, 212; 123/46 A; 91/417 R See application file for complete search history.

(56) References Cited

U.S. PATENT DOCUMENTS

| | | | | | |
|---|---|---|---|---|---|
| 787,960 | A | * | 4/1905 | Temple | 60/542 |
| 4,102,408 | A | * | 7/1978 | Ludvigson | 173/2 |
| 4,152,970 | A | * | 5/1979 | Hall et al. | 91/318 |
| 4,159,039 | A | | 6/1979 | Kasuga et al. | 173/1 |
| 4,676,323 | A | * | 6/1987 | Henriksson | 173/200 |
| 4,688,468 | A | * | 8/1987 | Axinti et al. | 91/317 |
| 4,817,737 | A | * | 4/1989 | Hamada et al. | 173/115 |
| 4,852,663 | A | * | 8/1989 | Hunt | 173/208 |
| 5,010,963 | A | * | 4/1991 | Neroznikov et al. | 173/105 |

FOREIGN PATENT DOCUMENTS

| | | | |
|---|---|---|---|
| WO | 03/004822 | | 1/2003 |
| WO | WO 2004073933 | A1 * | 9/2004 |

* cited by examiner

*Primary Examiner*—Rinaldi I. Rada
*Assistant Examiner*—Michelle Lopez
(74) *Attorney, Agent, or Firm*—Drinker Biddle & Reath LLP

(57) ABSTRACT

A pressure-fluid-operated percussion device includes a frame allowing a tool to be arranged movably in its longitudinal direction. Pressure liquid is fed to the percussion device and returned to a pressure liquid tank. A stress pulse is produced in the tool utilizing pressure of the pressure liquid. A pressure liquid source maintains pressure in the working pressure chamber. Pressure liquid is intermittently fed to the percussion device such that the pressure liquid pushes a transmission piston into a predetermined backward position. Pressure liquid is alternately discharged rapidly from the percussion device so that the pressure of the pressure liquid in the working pressure chamber and the pressure liquid flowing from the pressure liquid source pushes the transmission piston towards the tool, generating a stress pulse in the tool.

5 Claims, 3 Drawing Sheets

PRESSURE-FLUID-OPERATED PERCUSSION DEVICE

BACKGROUND OF THE INVENTION

The invention relates to a pressure-fluid-operated percussion device comprising a frame allowing a tool to be arranged therein movably in its longitudinal direction, means for feeding pressure liquid to the percussion device and for returning pressure liquid to a pressure liquid tank, and means for producing a stress pulse in the tool by utilizing pressure of the pressure liquid, wherein the percussion device comprises a working pressure chamber filled with pressure liquid and, between the working pressure chamber and the tool, a transmission piston which is movably arranged in the longitudinal direction of the frame and which is in contact with the tool either directly or indirectly at least during stress pulse generation, and a charging pressure chamber on the side of the transmission piston facing the tool so that the transmission piston is provided with a pressure surface facing the working pressure chamber and on the side of the charging pressure chamber a pressure surface facing the tool.

In the prior art, in a percussion device a stress pulse in a tool is produced by using a reciprocating percussion piston which, at the end of its stroke movement, hits an end of a tool or a shank connected thereto, thus producing in the tool a stress pulse propagating towards the material to be processed. The reciprocating stroke movement of a percussion piston is typically produced by means of a pressure medium whose pressure makes the percussion piston move in at least one direction, today typically in both directions. In order to enhance the stroke movement, a pressure accumulator or a spring or the like may be utilized to store energy during a return movement.

Due to the reciprocating movement of a percussion piston, acceleration forces in opposite directions are alternately produced in percussion devices equipped with a percussion piston which subject the mechanism to stress and impede control of the percussion device. In addition, due to such forces, boom structures and feeding apparatuses usually employed for supporting a percussion device have to be more robust than would otherwise be necessary. Furthermore, in order to make a stress pulse to be transferred from the tool to the material to be processed, such as rock to be broken, efficiently enough, the percussion device, and hence the tool, have to be pushed against the material with a sufficient force. Due to dynamic acceleration forces, the feed force and structures, accordingly, have to be dimensioned to be robust enough so that the pressing force on the tool which remains as a difference of acceleration caused by the feed force and the movement of the percussion piston would still be sufficiently large. Furthermore, percussion devices equipped with a percussion piston operating by a reciprocating stroke movement are only able to provide low stroke frequencies since to accelerate the percussion piston in its direction of movement always requires an amount of power proportional to the mass of the percussion piston, and high frequencies would require high acceleration and thus extremely high powers. This, in turn, is not feasible in practice, since all the rest in the percussion device and the support structure thereof would have to be dimensioned accordingly. When at the same time this would result in a considerable decrease in efficiency, the stroke frequency of existing percussion devices is only a few dozens of Hz at its best.

BRIEF DESCRIPTION OF THE INVENTION

An object of the present invention is to provide a percussion device to enable dynamic forces generated therein and drawbacks caused thereby to become significantly smaller. A further object is to provide a percussion device which has a good efficiency and which enables stress pulse frequencies significantly higher than existing ones to be provided.

The percussion device of the invention is characterized in that the means for producing a stress pulse comprise a pressure liquid source connected with the working pressure chamber in order to maintain pressure in the working pressure chamber, and means for intermittently feeding, to the charging pressure chamber, pressure liquid whose pressure enables the transmission piston to be pushed towards the working pressure chamber, against the pressure of the pressure liquid in the working pressure chamber and into a predetermined backward position of the transmission piston such that pressure liquid is discharged from the working pressure chamber, and for alternately allowing pressure liquid to be discharged rapidly from the charging pressure chamber so that a force produced by the pressure of the pressurized pressure liquid in the working pressure chamber and flowing thereto from the pressure liquid source pushes the transmission piston in the direction of the tool, compressing the tool in its longitudinal direction and thus generating a stress pulse in the tool.

A basic idea underlying the invention is that the transmission piston is continuously subjected to a pressure acting towards the tool, the pressure being derived from a pressure fluid source connected to the working pressure chamber.

A further basic idea underlying the invention is that pressurized pressure fluid is fed to a charging pressure chamber residing on another side of the transmission piston to move the transmission piston to a particular predetermined position, i.e. to a position wherefrom the transmission piston is allowed, by means of a force produced by the pressure in the working chamber, to abruptly compress the tool towards the material to be processed, thus producing a stress pulse in the tool.

Still another basic idea underlying the invention is that when the transmission piston is in said position and substantially in contact with the tool or shank, the charging pressure chamber is connected with a "tank pressure" so that the pressure acting on the opposite side of the transmission piston produces a sudden compression on the tool or the like, thus producing a stress pulse which propagates through the tool to the material to be processed.

An advantage of the invention is that this solution enables a good efficiency to be achieved since moving the transmission piston to a stress pulse initiating position, i.e. to a releasing position, takes place substantially against a constant pressure. A further advantage of the invention is that this enables the compressive stress energy of a stress wave being reflected from the material being processed via the tool and the transmission piston to the working pressure chamber to be recovered. A still further advantage is that the stress pulse generation frequency can be made considerably higher than that of the known percussion devices since there is no large-mass, and thus slow, percussion piston which is to be made to reciprocate. Still another advantage of the invention is that the solution is simple to implement and the operation is easy to control.

BRIEF DESCRIPTION OF THE DRAWINGS

The invention will be described in closer detail in the accompanying drawings, wherein.

DETAILED DESCRIPTION OF THE INVENTION

Figure 1A:
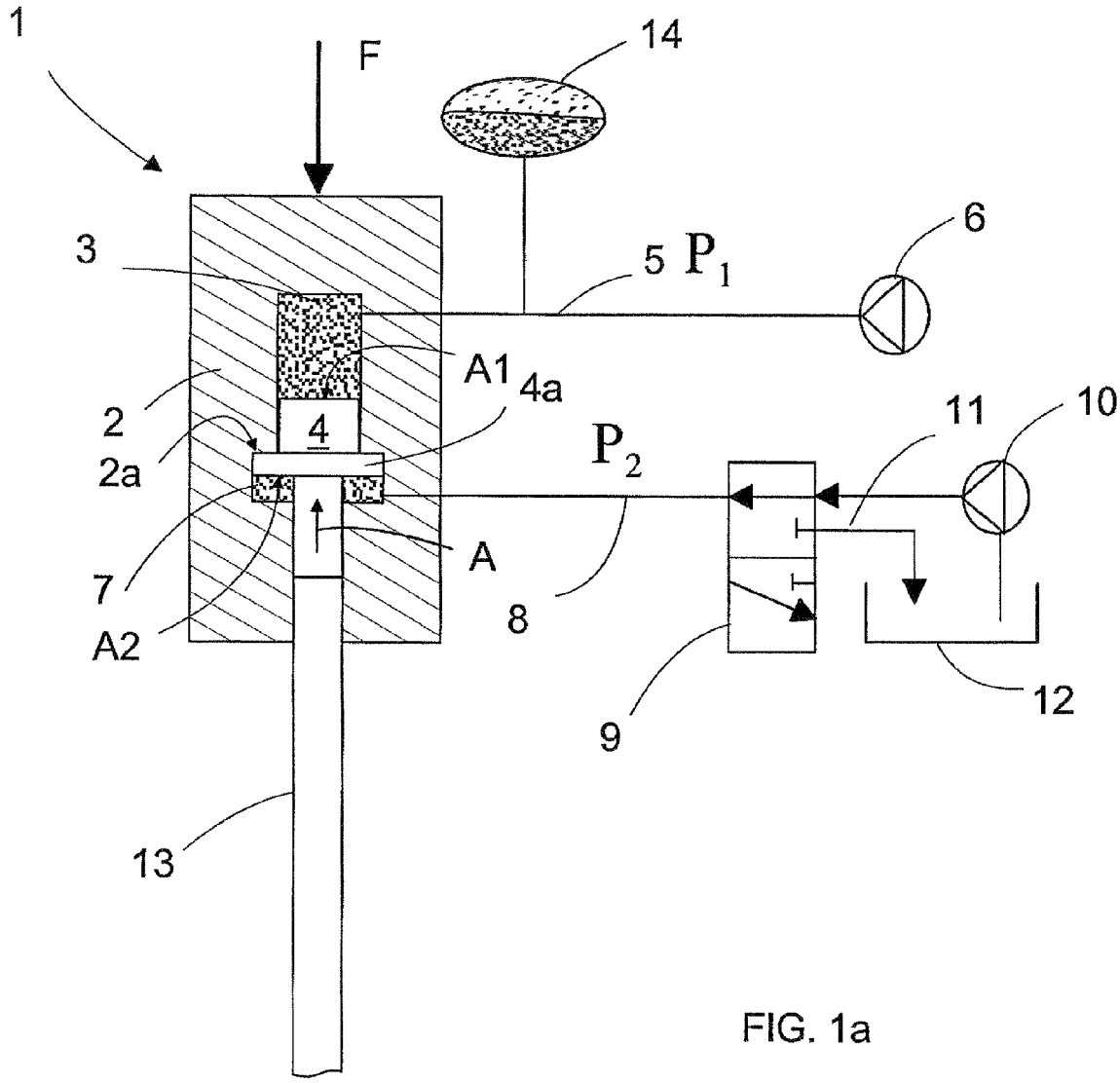
FIGS. 1*a* and 1*b* show principles of an embodiment of a percussion device according to the invention during charging and during stress pulse generation, respectively.

FIG. 1*a* schematically shows principles of an embodiment of a percussion device according to the invention in a situation wherein the percussion device is being "charged" in order to produce a stress pulse. The figure shows a percussion device 1 comprising a frame 2. For pressure liquid, the frame comprises a working pressure chamber 3 which, on one side, is defined by a transmission piston 4. The working pressure chamber 3 is connected via a channel 5 to a pressure source, such as a pressure liquid pump 6, which feeds pressurized pressure liquid to the space 3 at a pressure $P_1$. On the other side of the transmission piston 4, opposite to the pressure chamber 3, a charging pressure chamber 7 is provided which, in turn, is connected via a channel 8 and a valve 9 to a pressure liquid source, such as a pressure liquid pump 10, which feeds pressurized liquid whose pressure is $P_2$. From the valve 9, a pressure liquid return channel 11 is further provided to a pressure liquid tank 12.

A tool 13, which may be a drill rod or, typically, a shank connected to the drill rod, is further connected to the percussion device 1. At the opposite end of the tool, there is provided a drill bit, such as a rock bit or the like, not shown, which during operation is in contact with the material to be processed. It may further comprise a pressure accumulator 14 connected with the working pressure chamber 3 in order to dampen pressure pulses.

Figure 1B:
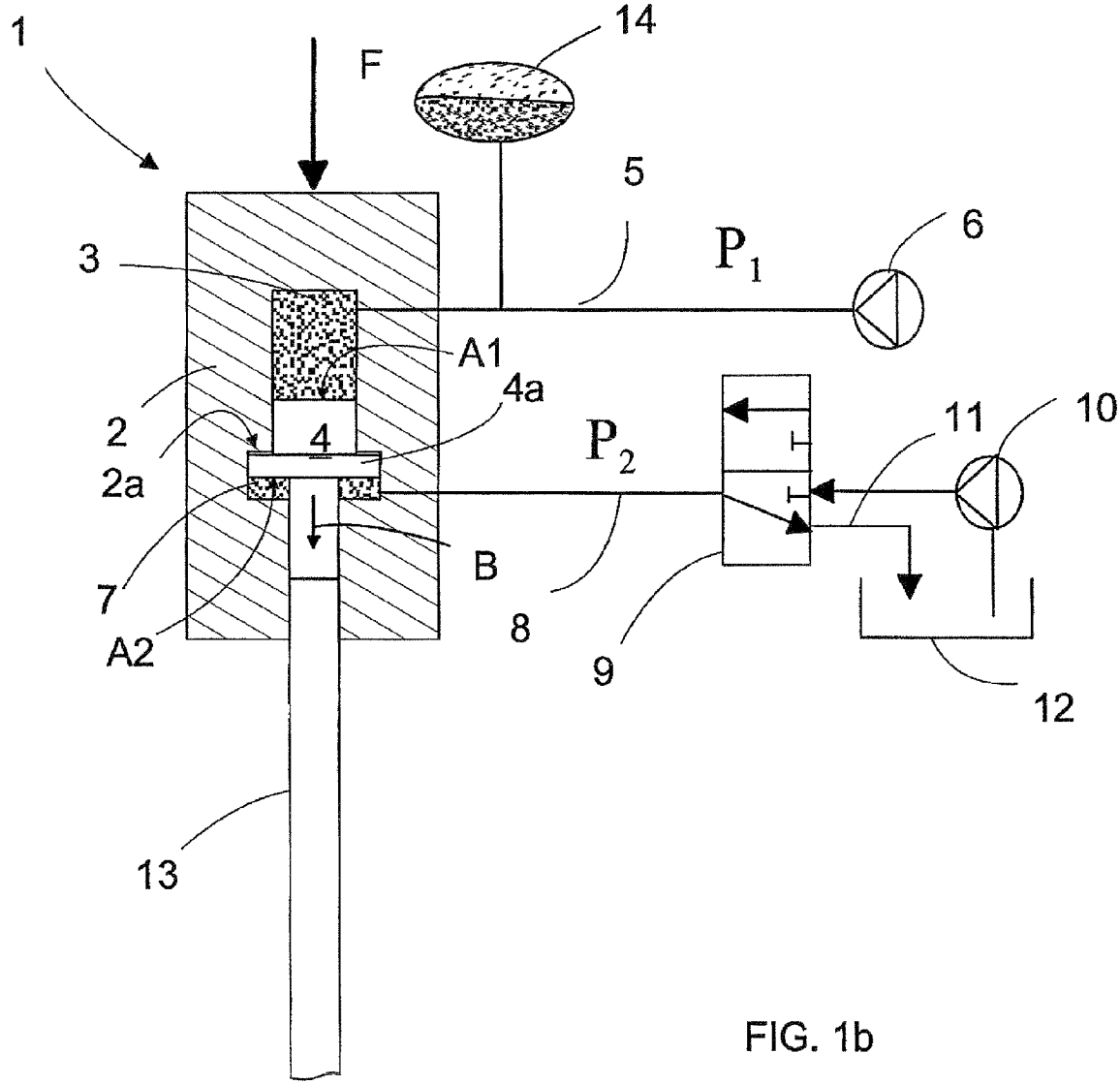

In the situation shown in FIG. 1*a*, "charging" is implemented wherein pressure liquid, controlled by the valve 9, is fed to the charging pressure chamber 7 such that the transmission piston 4 moves in the direction of arrow A until it has settled, in the position according to FIG. 1*a*, in its uppermost, i.e. backward, position. At the same time pressure liquid is discharged from the working pressure chamber. The backward position of the transmission piston 4 is determined by the mechanical solutions in the percussion device 1, such as various shoulders or stops; in the embodiment according to FIGS. 1*a* and 1*b*, a shoulder 2*a* and the rear surface of a flange 4*a* of the transmission piston. During operation of the percussion device, the percussion device 1 is pushed towards the material to be processed at force F, i.e. a "feed force", which keeps the transmission piston 4 in contact with the tool 13 and the tip thereof, i.e. a drill bit or the like, in contact with the material to be processed. When the transmission piston 4 has moved in the direction of arrow A as far as possible, the valve 9 is moved into the position shown in FIG. 1*b* so that pressure liquid from the charging pressure chamber 7 is allowed to abruptly discharge into the pressure liquid tank 12. The transmission piston is then allowed to move forward in the direction of the tool 13 due to the pressure of the pressure liquid in the working pressure chamber 3 and further flowing thereto from the pressure liquid pump 6. Pressure $P_1$ acting on the transmission piston 4 in the working pressure chamber 3 produces a force which pushes the transmission piston 4 in the direction of arrow B towards the tool 13, compressing the tool 13. As a result, a sudden compressive stress is generated in the tool 13 through the transmission piston 4, this sudden compressive stress thus producing a stress pulse through the tool 13 all the way to the material to be processed. A "reflection pulse" being reflected from the material being processed, in turn, returns through the tool 13, pushing the transmission piston 4 again in the direction of arrow A in FIG. 1*a* so that the energy of the stress pulse is transferred to the pressure liquid in the working pressure chamber. At the same time, the valve 9 is again switched to the position shown in FIG. 1*a*, and pressure liquid is again fed to the charging chamber 7 to push the transmission piston 4 to its predetermined backward position.

Pressure surface areas of the transmission piston 4, i.e. a surface area A1 facing the working pressure chamber 3 and a surface area A2 facing the charging chamber 7, respectively, can be chosen in many different ways. The simplest way of implementation is the embodiment shown in FIGS. 1*a* and 1*b* wherein the surface areas differ in size. In such a case, choosing the surface areas appropriately enables pressures of equal amount to be used on both sides of the transmission piston 4, i.e. pressures $P_1$ and $P_2$ may be equal in amount. Therefore, pressure liquid may enter both spaces from the same pressure liquid source. This simplifies the implementation of the percussion device. This, in turn, results in a further advantage that the transmission piston 4 may readily be provided with a shoulder-like flange 4*a* and the frame may readily be provided with a shoulder 2*a*, respectively, so that the shoulder 2*a* of the frame 2 defines the backward position of the transmission piston 4; in the figure the uppermost position, i.e. position where stress pulse generation always starts. The surface areas may also be equal in size, in which case pressure $P_2$ has to be higher than pressure $P_1$.

Figure 2A:
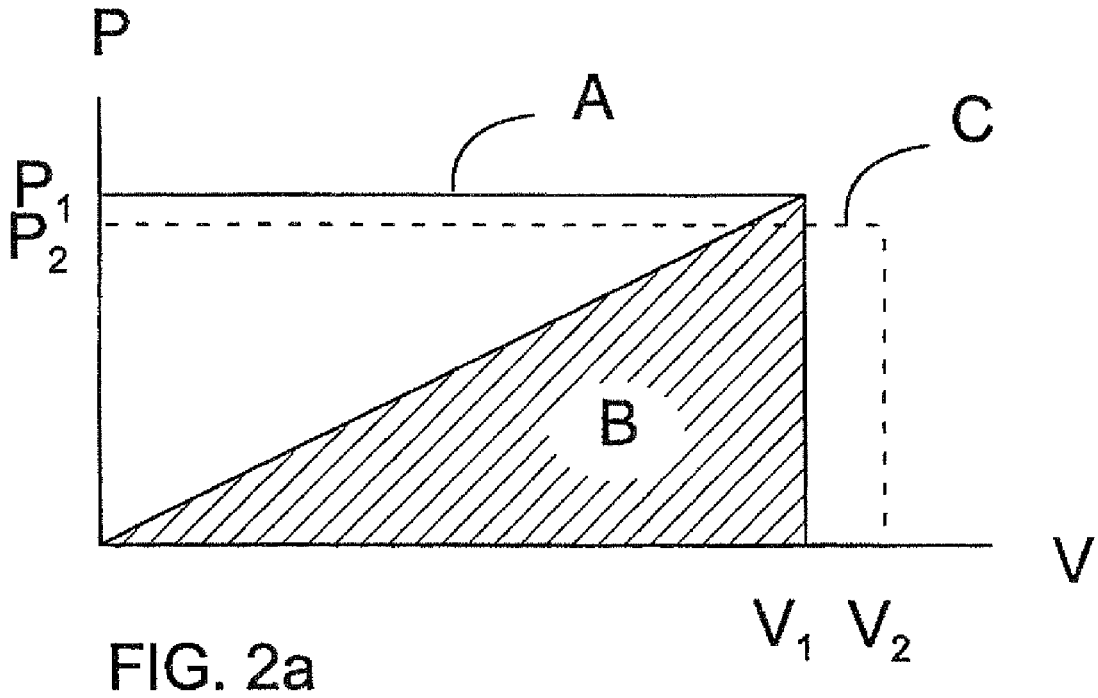
FIGS. 2*a* and 2*b* show theoretical energy graphs related to charging and stress pulse generation, respectively.
Figure 2B:
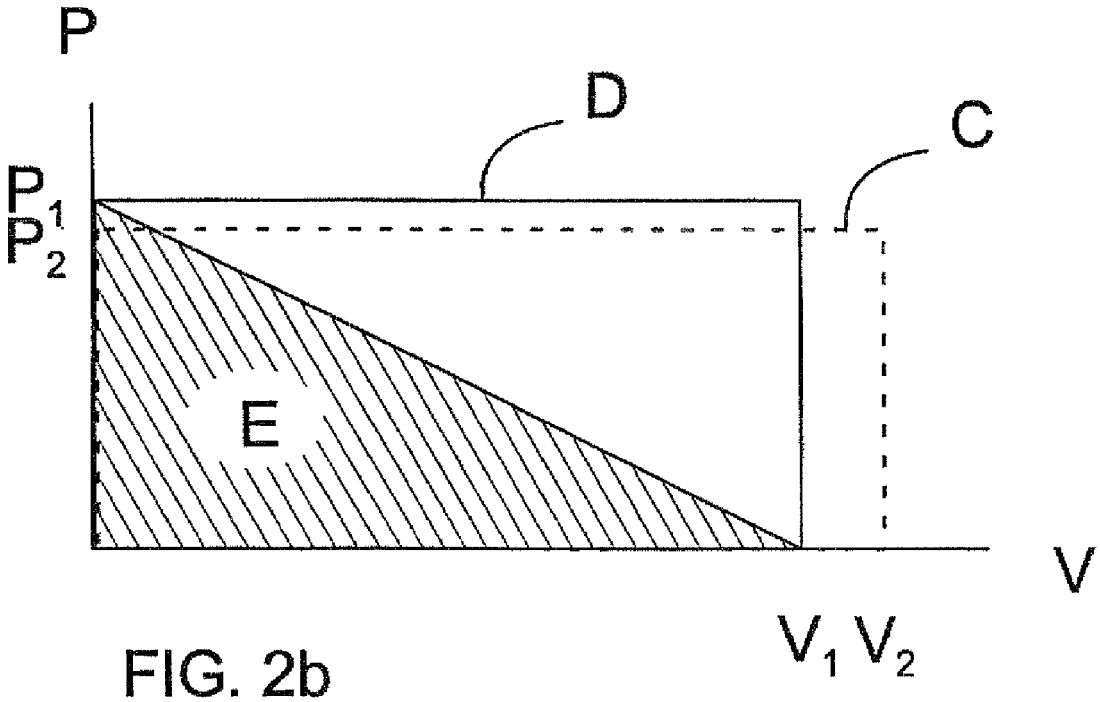

FIGS. 2*a* and 2*b* describe theoretical energy graphs related to charging and stress pulse generation, respectively, in a percussion device according to the invention.

When the transmission piston is moved according to FIG. 2*a* against pressure $P_1$ acting in the working pressure chamber, at the end the amount of charged energy is $P_1 \times V_1$, i.e. the product of pressure and volume replaced by a pressure area $A_1$, which is depicted by rectangle A. If the value of the pressure acting in the working pressure chamber would initially be 0, the amount of charged energy would be $P_1 \times V_1/2$, i.e. half the energy mentioned above, which is depicted by triangle B. Similarly, the amount of energy fed into the percussion device is depicted by rectangle C shown in broken line, which is the product of pressure $P_2$ (substantially constant) and an increase in volume $V_2$ that has occurred as a result of a transition of a pressure surface $A_2$. This surface area of rectangle C, i.e. the fed energy, is equal in size to the surface area of rectangle A.

When the transmission piston is according to FIG. 2*b* allowed to press the tool, the amount of energy transferred to a stress pulse is $P_1 \times V_1$, i.e. the product of pressure and said volume, which is depicted by rectangle D. If the value of the pressure acting in the working chamber would be 0 at the end, the amount of energy transferred to a stress pulse would be $P_1 \times V_1/2$, i.e. half the energy mentioned above, which is depicted by triangle E.

Although this theoretical examination does not accurately depict real operational processes and pressure levels in practice, it nevertheless provides a clear description as to how the percussion device of the invention, by employing the same pressure values of pressure liquid to be fed, enables power higher than that produced by devices wherein the pressure varies between zero and a maximum pressure to be achieved.

Using short travels in the direction of a tool, the percussion device according to the invention enables stress pulses to be produced at a high frequency since the necessary amounts of pressure liquid to be fed are relatively small while they at the same time enable a large force to be produced. Furthermore, since the mass of the transmission piston 4 is small, no significant dynamic forces are generated. Similarly, moving the transmission piston 4 into its backward position, i.e. starting position, only requires a short movement, thus enabling pulses and a high stress pulse frequency to be achieved, which results in a high frequency of stress pulses between the tool and the material to be processed, usually also called a stroke frequency in connection with known percussion devices. The drawings and the related description are only intended to illustrate the idea of the invention. The details of the invention may vary within the scope of the claims.

The invention claimed is:

1. A pressure-fluid-operated percussion device comprising a frame allowing a tool to be arranged within the frame and movable in its longitudinal direction, means for feeding pressure liquid to the percussion device and for returning pressure liquid to a pressure liquid tank, and means for producing a stress pulse in the tool by utilizing pressure of the pressure liquid, wherein the percussion device comprises a working pressure chamber filled with pressure liquid and, between the working pressure chamber and the tool, a transmission piston which is movably arranged in the longitudinal direction of the frame and which is in contact with the tool at least during stress pulse generation, and a charging pressure chamber on the side of the transmission piston facing the tool so that the transmission piston is provided with a pressure surface facing the working pressure chamber and on the side of the charging pressure chamber a pressure surface facing the tool, wherein the means for producing a stress pulse comprise a pressure liquid source connected with the working pressure chamber in order to maintain pressure in the working pressure chamber, and means for intermittently feeding, to the charging pressure chamber, pressure liquid whose pressure enables the transmission piston to be pushed towards the working pressure chamber, against the pressure of the pressure liquid in the working pressure chamber and into a predetermined backward position of the transmission piston such that pressure liquid is discharged from the working pressure chamber, and, when the transmission piston is in said position and substantially in contact with the tool, for alternately allowing pressure liquid to be discharged rapidly from the charging pressure chamber so that a force produced by the pressure of the pressurized pressure liquid in the working pressure chamber and flowing thereto from the pressure liquid source pushes the transmission piston in the direction of the tool, compressing the tool in its longitudinal direction and thus generating a stress pulse in the tool while maintaining the piston in contact with the tool during compression of the tool, wherein the means for feeding pressurized pressure liquid to the working pressure chamber are arranged to feed the pressure liquid such that the pressure in the working pressure chamber remains substantially constant during operation of the percussion device.

2. A percussion device as claimed in claim 1, wherein the pressure liquid of equal pressure is fed to the working chamber and to the charging pressure chamber, and that the pressure surfaces of the transmission piston facing the working pressure chamber and the charging pressure chamber, respectively, are dimensioned such that a sum of forces being formed pushes the transmission piston into its backward position.

3. A percussion device as claimed in claim 1, wherein the working pressure chamber is connected to a pressure liquid source such that the pressure liquid source tries to feed pressure liquid thereto continuously.

4. A percussion device as claimed in claim 1, wherein it comprises a pressure accumulator connected with the working pressure chamber.

5. The percussion device as claimed in claim 1, wherein the pressure liquid source is a pressure liquid pump.

* * * * *